US006323405B1

(12) United States Patent
Yu

(10) Patent No.: US 6,323,405 B1
(45) Date of Patent: Nov. 27, 2001

(54) MULTIFUNCTIONAL GUITAR STAND

(76) Inventor: Ming-Ti Yu, 122-5, Jun Liao Road, Feng Yuan, Taichung Hsien (TW)

( * ) Notice: Subject to any disclaimer, the term of this patent is extended or adjusted under 35 U.S.C. 154(b) by 0 days.

(21) Appl. No.: 09/336,177

(22) Filed: Jun. 18, 1999

(51) Int. Cl.[7] ..... G10D 3/00
(52) U.S. Cl. ..... 84/327; 84/453
(58) Field of Search ..... 84/327, 422.2, 84/422.3, 422.1, 453; 248/443, 121, 122.1

(56) References Cited

U.S. PATENT DOCUMENTS

| | | | | |
|---|---|---|---|---|
| 1,045,583 | | 11/1912 | Mills | 84/327 |
| 5,372,346 | | 12/1994 | Upchurch et al. | 248/304 |
| 5,375,497 | | 12/1994 | Pirchio et al. | 84/327 |
| 5,383,634 | | 1/1995 | Liao | 248/166 |
| 5,505,413 | * | 4/1996 | Hennessey | 248/166 |
| 5,645,256 | | 7/1997 | Thomas, II | 248/222.11 |
| 5,664,756 | | 9/1997 | Liao | 248/443 |
| 5,713,547 | * | 2/1998 | Yu | 248/166 |
| 5,726,369 | | 3/1998 | Gilday | 84/327 |
| 5,836,552 | | 11/1998 | Yu | 248/166 |
| 5,852,250 | | 12/1998 | Cha | 84/327 |
| 5,957,417 | | 9/1999 | Yu | 248/166 |
| 5,959,225 | | 9/1999 | Hsu | 84/327 |

* cited by examiner

*Primary Examiner*—Robert B. Nappi
*Assistant Examiner*—Kim Lockett
(74) *Attorney, Agent, or Firm*—Alan Kamrath; Rider, Bennett, Egan & Arundel, LLP

(57) ABSTRACT

A multifunctional guitar stand has a tripod stand, a lower pipe disposed on the tripod stand, a middle pipe inserted in the lower pipe, a T-shaped joint disposed on the middle pipe, an upper pipe inserted in the T-shaped joint, a microphone stand disposed on the upper pipe receiving a microphone, a retaining fork device connected to the T-shaped joint, and a U-shaped fork inserted through the lower pipe.

2 Claims, 4 Drawing Sheets

MULTIFUNCTIONAL GUITAR STAND

BACKGROUND OF THE INVENTION

The present invention relates to a multifunctional guitar stand. More particularly, the present invention relates to a multifunctional guitar stand which can receive a guitar, a microphone, and a music rest.

Referring to FIG. 4, a conventional guitar stand has a lower rod 91 and three legs 96 connected by a four-way joint 97. An upper rod 94 is inserted in the lower rod 91. A U-shaped upper fork 95 extends from an upper end of the upper rod 94. A transverse pipe 93 is connected to the lower rod 91. A U-shaped lower fork 92 is inserted in the transverse pipe 93. Since the upper rod 94 is inserted in the lower rod 91 only, the upper rod 94 and the lower rod 91 are not fastened tightly. The upper rod 94 may fall down after a long period of usage. Furthermore, the upper rod 94 and the U-shaped upper fork 95 will occupy a large room while transporting.

SUMMARY OF THE INVENTION

An object of the present invention is to provide a guitar stand which is easily adjusted.

Another object of the present invention is to provide a guitar stand which has a T-shaped joint having a first recess and a second recess so that the user can hold the T-shaped joint easily via the first recess and the second recess.

Another object of the present invention is to provide a guitar stand which can receive a guitar.

Another object of the present invention is to provide a guitar stand which can receive a microphone.

Another object of the present invention is to provide a guitar stand which can receive a music rest.

Accordingly, a multifunctional guitar stand comprises a tripod stand, a lower pipe disposed on the tripod stand, a middle pipe inserted in the lower pipe, a T-shaped joint disposed on the middle pipe, an upper pipe inserted in the T-shaped joint, a microphone stand disposed on the upper pipe, a retaining fork device connected to the T-shaped joint, and a U-shaped fork inserted through the lower pipe. The T-shaped joint has a transverse block, and a longitudinal tube inserted through the transverse block. The longitudinal tube has a through hole receiving a lower end of the upper pipe and an upper end of the middle pipe. The transverse block has a threaded hole, a distal flange, a blocking protrusion, a first recess, and a second recess. The retaining fork device has a threaded aperture, a neck rod, and two curved bars. The neck rod is inserted in the transverse block. A bolt fastens the neck rod and the transverse block pivotally via the threaded aperture and the threaded hole.

DETAILED DESCRIPTION OF THE INVENTION

Figure 1:
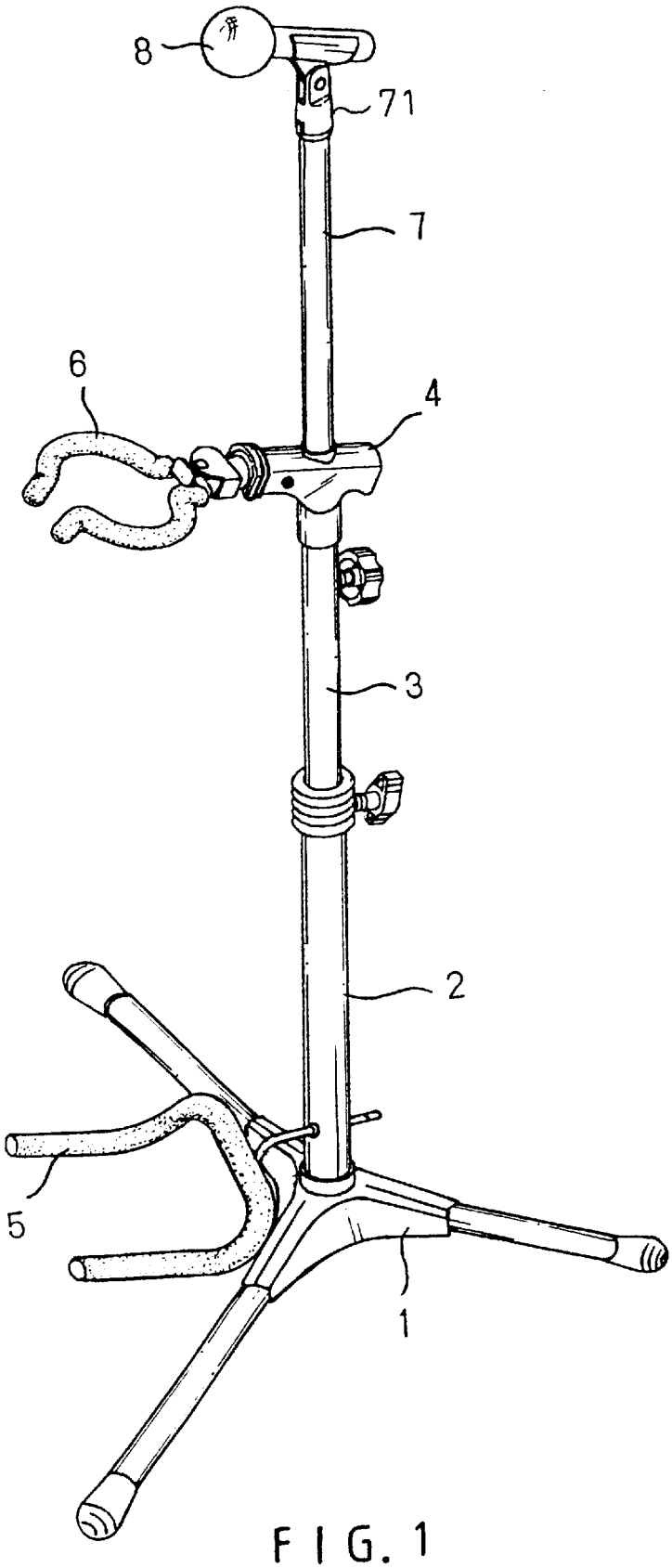
FIG. 1 is a perspective assembly view of a multifunctional guitar stand of a preferred embodiment in accordance with the present invention.
Figure 2:
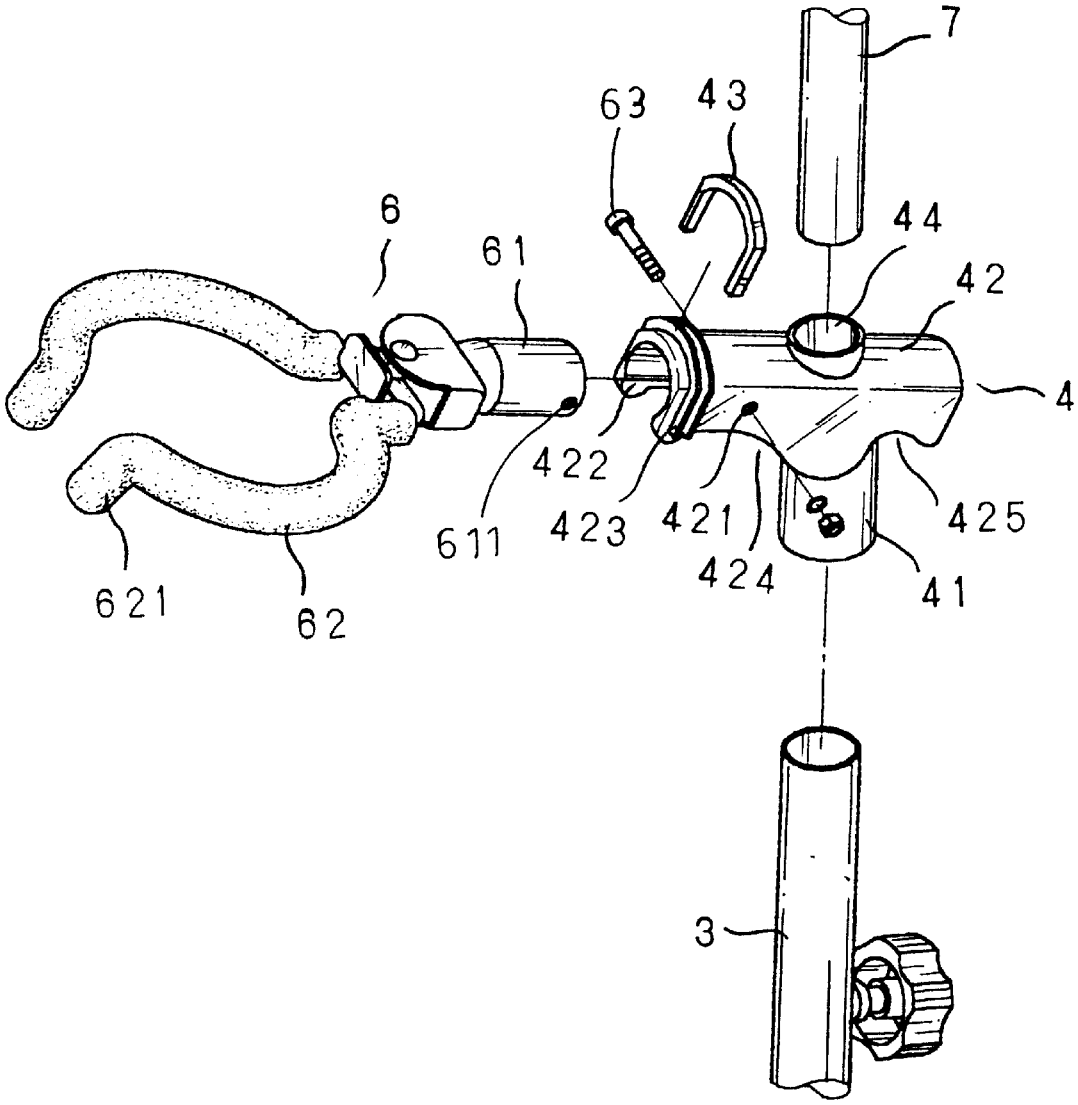
FIG. 2 is a perspective exploded view of a T-shaped joint, a retaining fork device, an upper rod, and a middle rod of a preferred embodiment in accordance with the present invention.
Figure 3:
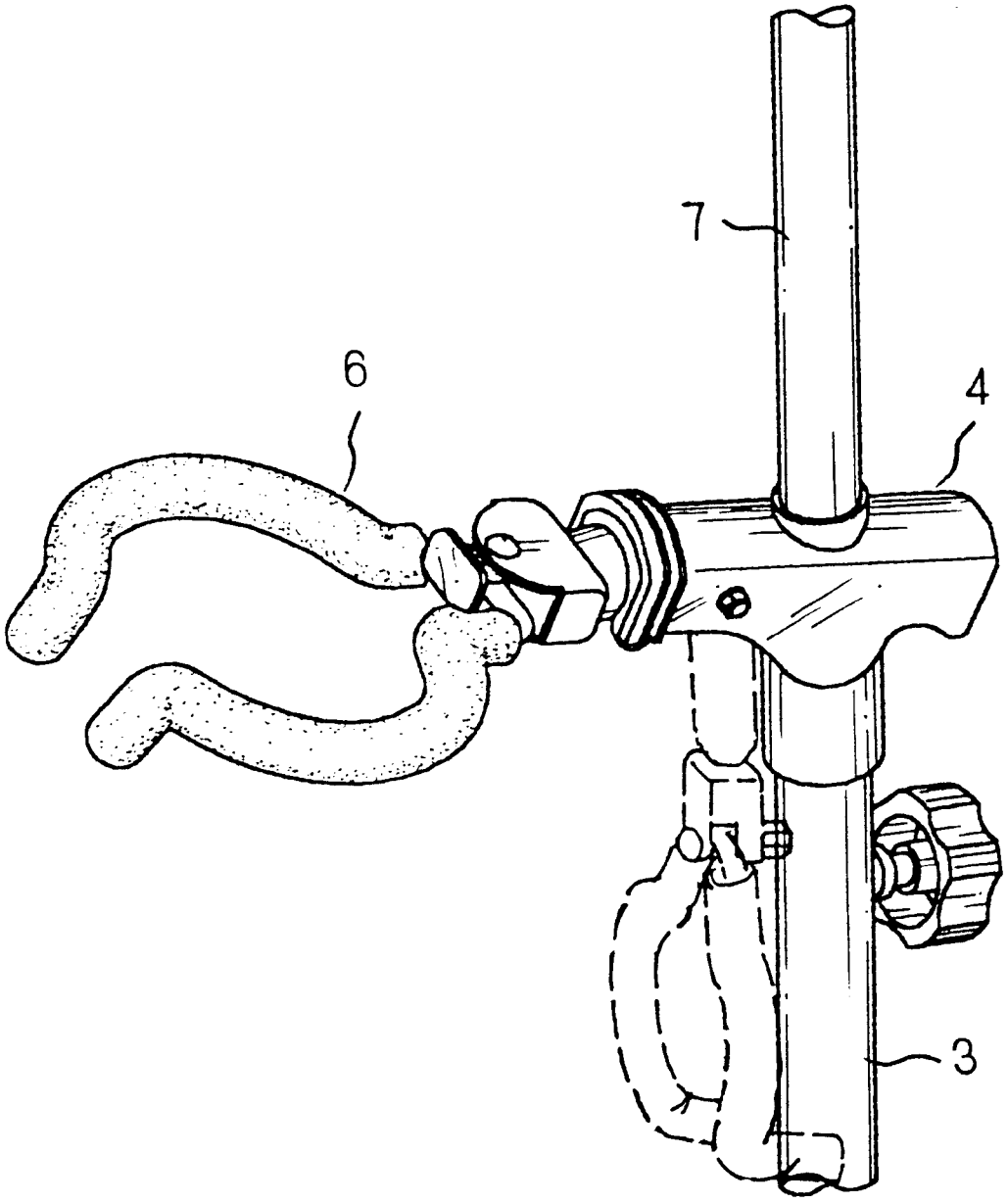
FIG. 3 is a perspective assembly view of a T-shaped joint, a retaining fork device, an upper rod, and a middle rod of a preferred embodiment in accordance with the present invention.
Figure 4:
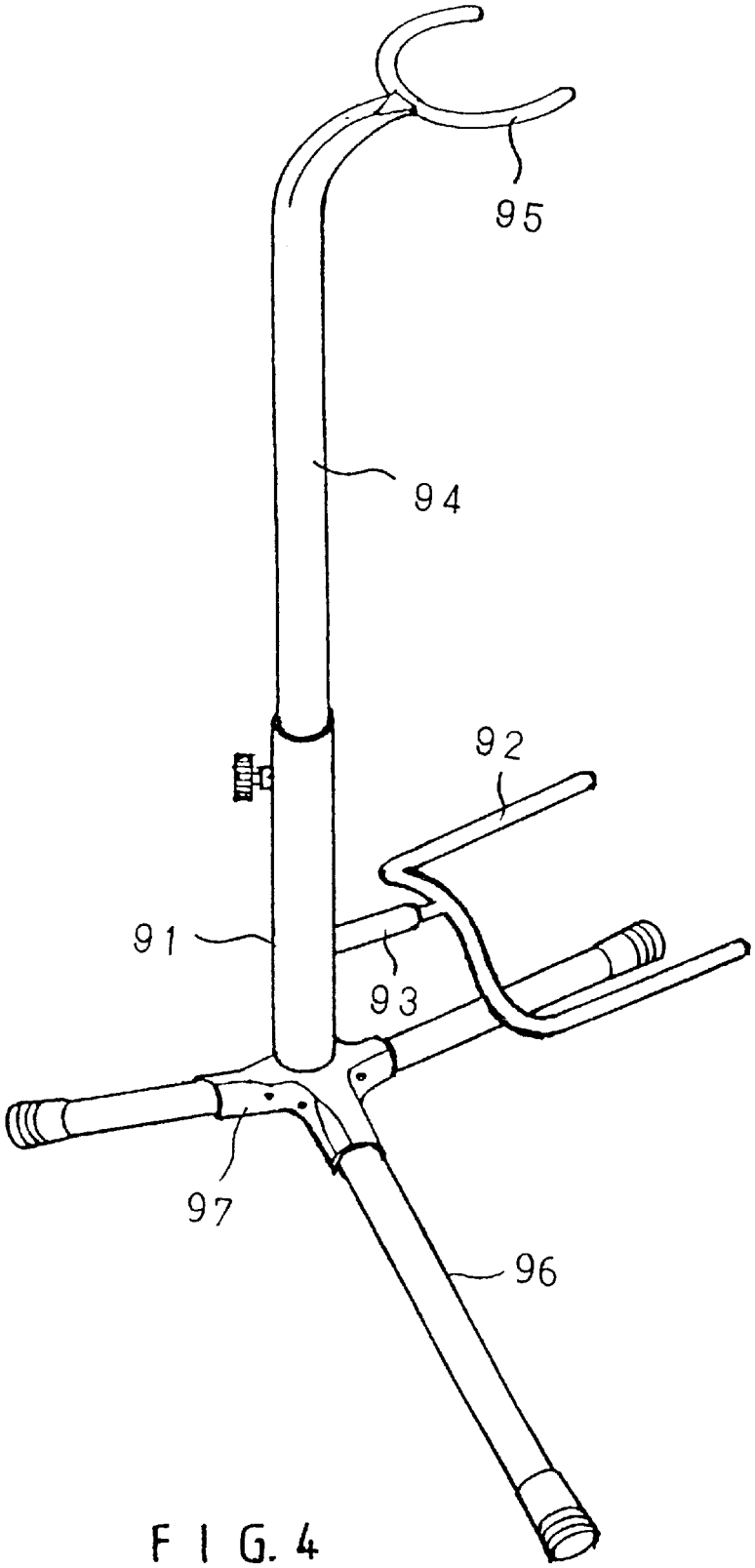
FIG. 4 PRIOR ART
FIG. 4 is a perspective assembly view of a guitar stand of the prior art.

Referring to FIGS. 1 to 3, a multifunctional guitar stand comprises a tripod stand 1, a lower pipe 2 disposed on the tripod stand 1, a middle pipe 3 inserted in the lower pipe 2, a T-shaped joint 4 disposed on the middle pipe 3, an upper pipe 7 inserted in the T-shaped joint 4, a microphone stand 71 disposed on the upper pipe 7 receiving a microphone 8, a retaining fork device 6 connected to the T-shaped joint 4, and a U-shaped fork 5 inserted through the lower pipe 2.

The T-shaped joint 4 has a transverse block 42, and a longitudinal tube 41 inserted through the transverse block 42.

The longitudinal tube 41 has a through hole 44 receiving a lower end of the upper pipe 7 and an upper end of the middle pipe 3.

The transverse block 42 has a threaded hole 421, a distal flange 422, a blocking protrusion 423, a first recess 424, and a second recess 425. A U-shaped elastic element 43 clamps the blocking protrusion 423.

The retaining fork device 6 has a threaded aperture 611, a neck rod 61, and two curved bars 62. Each of the curved bars 62 has a bent push end 621 so that the user can push the respective curved bar 62 outward via the respective bent push end 621.

The neck rod 61 is inserted in the transverse block 42. A bolt 63 fastens the neck rod 61 and the transverse block 42 pivotally via the threaded aperture 611 and the threaded hole 421.

The user can hold the T-shaped joint 4 easily via the first recess 424 and the second recess 425.

Referring to FIG. 3 again, the retaining fork device 6 can be turned downward.

Furthermore, the microphone stand 71 can be replaced by a music stand in order to receive a music rest.

The present invention is not limited to the above embodiment but various modification thereof may be made. Furthermore, various changes in form and detail may be made without departing from the scope of the present invention.

I claim:

1. A multifunctional guitar stand comprises:

a tripod stand, a lower pipe disposed on the tripod stand, a middle pipe inserted in the lower pipe, a T-shaped joint disposed on the middle pipe, an upper pipe inserted in the T-shaped joint, a microphone stand disposed on the upper pipe, a retaining fork device connected to the T-shaped joint, a U-shaped fork inserted through the lower pipe, the T-shaped joint having a transverse block, and a longitudinal tube inserted through the transverse block, the longitudinal tube having a through hole receiving a lower end of the upper pipe and an upper end of the middle pipe, the transverse block having a threaded hole, a distal flange, a blocking protrusion, a first recess, and a second recess, the retaining fork device having a threaded aperture, a neck rod, and two curved bars, the neck rod inserted in the transverse block, and a bolt fastening the neck rod and the transverse block pivotally via the threaded aperture and the threaded hole.

2. The multifunctional guitar stand as claimed in claim 1, wherein each of the curved bars has a bent push end.

* * * * *